US006830413B2

(12) United States Patent
Wybro et al.

(10) Patent No.: US 6,830,413 B2
(45) Date of Patent: Dec. 14, 2004

(54) BALLAST SYSTEM FOR TENSION LEG PLATFORM

(75) Inventors: Pieter G. Wybro, Houston, TX (US); Terry Kryska, Bellville, TX (US)

(73) Assignee: Modec International, L.L.C., Houston, TX (US)

( * ) Notice: Subject to any disclaimer, the term of this patent is extended or adjusted under 35 U.S.C. 154(b) by 0 days.

(21) Appl. No.: 10/723,212

(22) Filed: Nov. 26, 2003

(65) Prior Publication Data

US 2004/0131427 A1 Jul. 8, 2004

Related U.S. Application Data

(60) Provisional application No. 60/429,459, filed on Nov. 27, 2002.

(51) Int. Cl.[7] ..... B63B 35/44; B63B 39/03; B63B 43/06; E02D 23/02; E02D 23/08

(52) U.S. Cl. ..... 405/195.1; 405/205; 114/125; 114/265

(58) Field of Search ..... 405/195.1, 203–205, 405/207, 208; 114/258, 271, 125, 264, 265

(56) References Cited

U.S. PATENT DOCUMENTS 3,209,715 A * 10/1965 Campbell et al. ..... 114/74 R
3,797,437 A * 3/1974 Cowles ..... 114/74 A
3,921,558 A * 11/1975 Redshaw ..... 114/256
3,943,873 A * 3/1976 Hering et al. ..... 114/125
4,276,849 A 7/1981 Bloxham ..... 114/125
4,314,519 A 2/1982 Yunoki et al. ..... 114/125
4,511,288 A * 4/1985 Wetmore ..... 405/217
4,695,201 A * 9/1987 Beskow et al. ..... 405/224.1
4,759,307 A * 7/1988 Scott ..... 114/74 R
4,864,958 A * 9/1989 Belinsky ..... 114/265
5,135,327 A 8/1992 White et al. ..... 405/224
5,147,148 A * 9/1992 White et al. ..... 405/199
5,353,728 A * 10/1994 Strange ..... 114/74 R
6,378,451 B1 4/2002 Wetch et al. ..... 114/265
6,409,431 B1 * 6/2002 Lynch ..... 405/200

* cited by examiner

*Primary Examiner*—Thomas B. Will
*Assistant Examiner*—Tara L. Mayo
(74) *Attorney, Agent, or Firm*—Gary L. Bush; Andrews Kurth LLP

(57) ABSTRACT

An apparatus and method for ballasting and de-ballasting a vessel having a hull with a plurality of watertight ballast compartments wherein each ballast compartment has an individual pump caisson extending vertically to the top of the hull, but the ballast/de-ballast system contains no valves within the hull. An external caisson is used to provide a source of seawater. Several submersible pumps are available for rigging into and out of the internal and external caissons and provide the ballast and de-ballast operations via an installed manifold system at the top of the columns. Venting of the ballast tanks may be accomplished through a connection to atmosphere near the top of the pump caissons.

16 Claims, 4 Drawing Sheets

BALLAST SYSTEM FOR TENSION LEG PLATFORM

CROSS REFERENCE TO RELATED APPLICATION

This application is based upon provisional application No. 60/429,459 filed on Nov. 27, 2002, the priority of which is claimed.

BACKGROUND OF THE INVENTION

1. Field of the Invention

This invention relates generally to tension leg platforms used in the offshore oil production industry and specifically to a method and system for ballasting and de-ballasting a tension leg platform for towing, installation (lock-off to tendons) and use during in-service operation of the platform.

2. Description of the Prior Art

Tension leg platforms (TLP) are generally used offshore in deep water for the production of oil. A typical TLP has a horizontal pontoon hull structure and vertical columns supporting a platform. The hull structure provides buoyancy to the columns and platform. The TLP is anchored by tendons to pilings in the ocean floor, and it is held stationary by buoyancy-induced tension in the tendons.

The hull is generally divided into several watertight compartments in order to meet stability requirements during installation ballasting. TLPs are de-ballasted during installation to tension the tendons, maintaining the platform within design limits at all times. The de-ballasting operation is rapid to minimize the time during which the resonant frequency of TLP equals the natural period of the surrounding water. In order to rapidly de-ballast, TLPs are generally equipped with one or more pump rooms containing high-capacity pumps. However, once installation is complete, only minor in-service trim adjustments are made, so the pumps are no longer subjected high-capacity requirements.

To minimize the capital investment of permanently installed large pumps for limited use, alternative TLP designs use a single caisson in fluid communication with the ballast compartments to temporarily house a high-capacity submersible pump. Large remotely actuated valves are located low in the hull to isolate or enable flow from a particular ballast tank to the pump caisson. These valves and their associated instrumentation and controls require inspection, maintenance, repair and/or replacement, which can be costly.

IDENTIFICATION OF OBJECTS OF THE INVENTION

A primary object of the invention is to provide a buoyant vessel with an arrangement that enables controlled ballasting and de-ballasting from the top of the hull without the need for a pump room, machinery room, valves, permanent pumps, instrumentation, wiring or controls located in the lower hull.

Another object of the invention is to provide a vessel for use as a tension leg platform which requires no access to the lower hull for machinery inspection, maintenance, repair or replacement.

Another object of the invention is to provide a method of ballasting and de-ballasting a tension leg platform for tow and installation, wherein portable submersible pumps are employed to ballast and de-ballast individual compartments having individual pump caissons.

Another object of the invention is to simplify ballast level instrumentation by providing individual compartment caissons for manual or electric soundings.

Another object of the invention is to simplify the ballast compartment vent system by providing ballast compartment vents directly to pump caissons.

SUMMARY OF THE INVENTION

The objects identified above, as well as other features and advantages of the invention are incorporated in an apparatus for ballasting and de-ballasting a tension leg platform (TLP). The TLP includes a hull which provides the buoyancy to tension the tendons and to support the topsides and four columns which support a deck. The hull includes temporary and permanent ballast tanks, but it contains no valves. The columns connecting the deck to the hull are stripped of a majority of conventional "active-column" components including electrical equipment, instrumentation, etc. Each column includes one or more internal caissons disposed in the middle of the column and which run vertically from the upper hull to the lower hull. The bottom of the caissons are connected to the bottom of permanent and temporary ballast tanks and allow deployment of submersible pumps to facilitate ballasting and de-ballasting of individual tanks. Each column also has one or more external caissons which are used to provide a source of seawater. Several submersible pumps are available for rigging into and out of the internal and external caissons and provide the ballast and de-ballast operations via an installed manifold system at the top of the columns. Venting of the ballast tanks can be accomplished through a connection to atmosphere near the top of the pump caissons. Alternatively, separate vent lines may be used to vent the ballast tanks The invention includes a method of ballasting and de-ballasting a vessel having ballast compartments with individual pump caissons.

BRIEF DESCRIPTION OF THE DRAWINGS

The invention is described in detail hereinafter on the basis of the embodiments represented schematically in the accompanying figures, in which.

DESCRIPTION OF THE PREFERRED EMBODIMENT OF THE INVENTION

Figure 1:
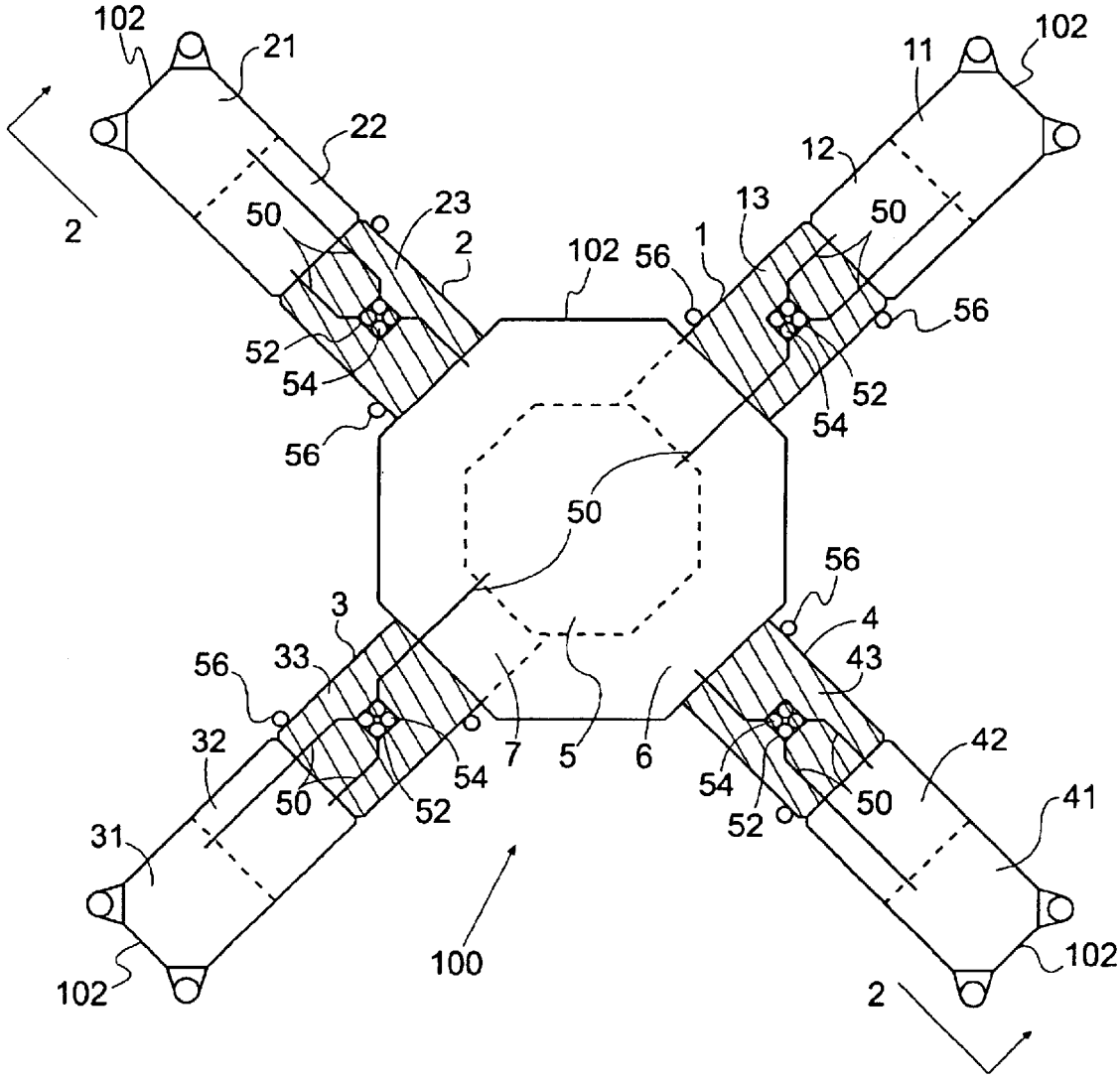
FIG. 1 is a top view cross section of a TLP viewed along the lines 1—1 of FIG. 2 showing four columns each containing four internal pump caissons and associated piping between the ballast tanks and the pump caissons.
Figure 2:
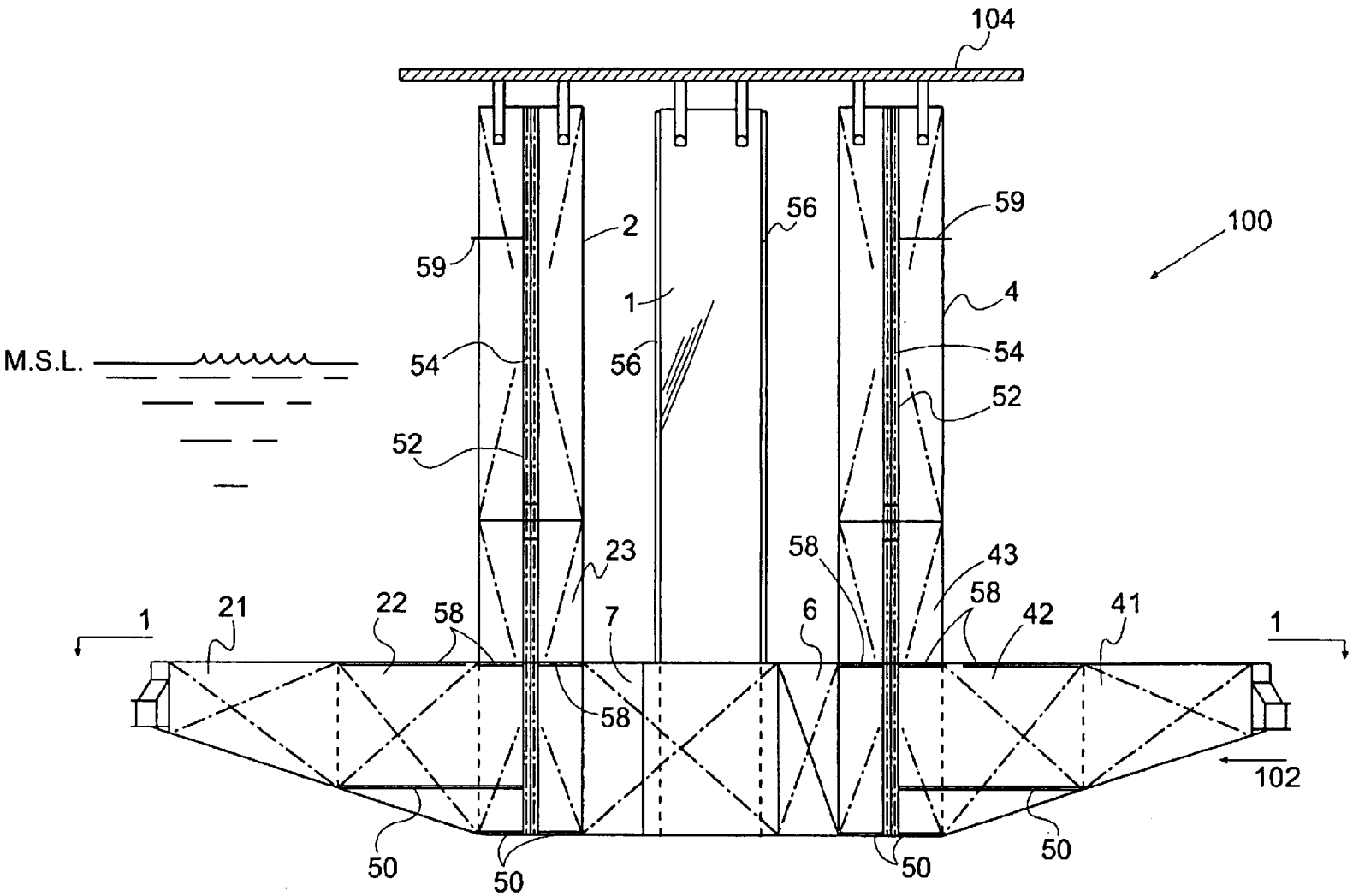
FIG. 2 is a side view cross section of the TLP taken along the lines 2—2 of FIG. 1.

As shown in FIGS. 1 and 2, the ballast and de-ballast system is preferably employed in a tension leg platform (TLP) 100 having four columns 1, 2, 3, 4 supporting a deck 104 and a hull 102. The hull 102 has fifteen internal ballast tanks. There are four permanent ballast tanks 11, 21, 31, 41 that are the most outboard tanks in the hull 102. There are eleven tanks within the hull 102 used only temporarily for towing and installation of the TLP to the tendons: Four of these temporary ballast tanks 12, 22, 32, 42 are located immediately inboard of the four permanent ballast tanks 11, 21, 31, 41; four temporary ballast tanks 13, 23, 33, 43 are located at the base of the columns 1, 2, 3, 4, respectively; the three central tanks are the base center tank 5, the wing tank east 6, and the wing tank west 7.

The ballast tanks are accessed through the four columns 1, 2, 3, 4 of the TLP 100. Each column 1, 2, 3, 4 contains four individual pump caissons 54. Preferably, the pump caissons have a 20 inch outer diameter and are constructed of steel or a composite material. Each tank is connected to a pump caisson 54; the caisson serves both for fill and discharge of the tank. Because there are four pump caissons 54 per column, one pump caisson 54 is connected to each temporary or permanent ballast tank, except the center tank which is connected to two pump caissons 54.

Within each column 1, 2, 3, 4, the four pump caissons are collectively housed in a single caisson 52 for added structural support.

Except for column ballast tanks 13, 23, 33, 43, the pump caissons 54 are connected to the individual ballast tanks via a dual-purpose 10 inch fill/discharge pipes 50. The ballast tanks are also vented to the atmosphere through 12 inch vent pipes 58 connecting the top of the ballast tanks to their associated pump caissons 54 and through 12 inch vent pipes 59 extending from the pump caissons 54 to the atmosphere near the top of the columns 1, 2, 3, 4. (See FIGS. 2–4).

Each column 1, 2, 3, 4 contains at least one external caisson 56 for seawater supply to various systems such as a firefighting system. Each of these external caissons 56 extends from 2 ft above the top of the columns 1, 2, 3, 4 to within 5 ft of the hull 102 keel.

Figure 3:
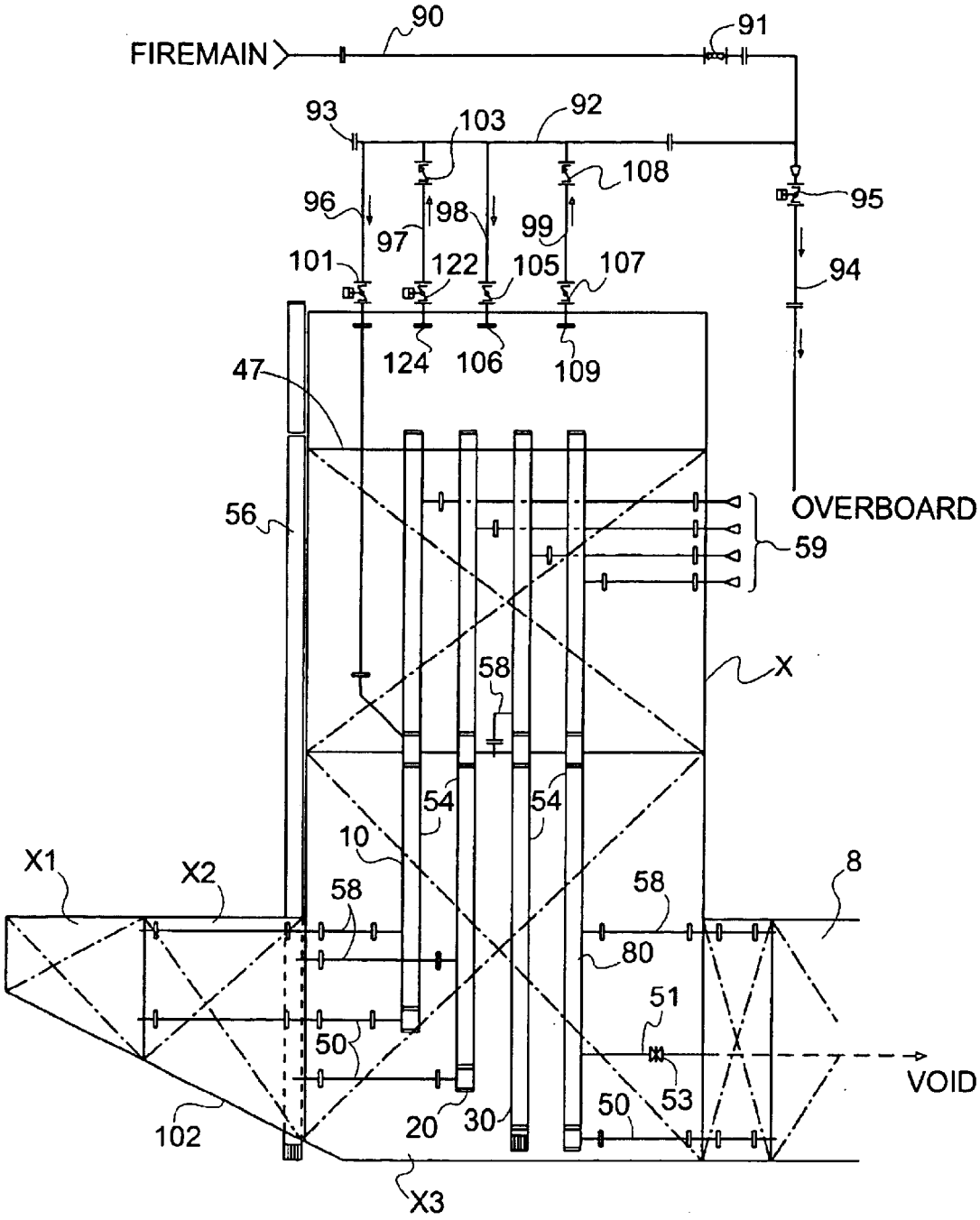
FIG. 3 is a schematic diagram showing permanent and temporary ballast systems and associated manifold piping according to the invention.

FIG. 3 is a partial schematic diagram of the ballast/de-ballast system of the invention. Since all four columns 1, 2, 3, 4 are essentially identical, only one is shown. FIG. 3 shows the system for one generic column X of the TLP 100. The central ballast tank 5, 6, or 7 associated with column X is generically designated as 8. The outboard permanent ballast tank 11, 21, 31, or 41 is designated by X1. The temporary ballast tank 12, 22, 32, or 42 is designated as X2, and the column tank 13, 23, 33, or 43 is designated as X3. The pump caisson 54 associated with ballast tank X1 is designated as 10. The pump caisson 54 associated with ballast tank X2 is designated as 20. The pump caisson 54 associated with tank X3 is designated as 30, and the pump caisson 54 associated with generic central tank 8 is designated as 80.

For simplicity, the following description and procedures are written for one generic column X. Unless otherwise indicated, the description and procedures apply concurrently to all four columns 1, 2, 3, 4. For example, if a procedure calls for one particular component, in total four particular components are needed for TLP 100, or if a procedure calls to fill tank X2, tanks 12, 22, 32, 42 are all concurrently filled.

Pump caisson 54 can have optional branch piping 51 to one or more void compartments which are used neither for ballasting nor de-ballasting. The branch piping 51 is fitted with an isolation valve 53 which for normal ballasting operations remains shut.

FIG. 3 illustrates the manifold system which allows filling of any ballast tank X1, X2, X3, 8 with water supplied by a firemain system or by a temporary ballast system. The manifold system allows the transfer of water between any two ballast tanks X1, X2, X3, 8, and the manifold system allows de-ballasting of any tank X1, X2, X3, 8, directing the water overboard. The manifold system includes piping which is located at the top of column X and extends to the inside of the hull 102.

The manifold system includes firemain inlet piping 90 and a manually operated firemain isolation ball valve 91 tied to one end of a common ballast/de-ballast header 92. The other end of common header 92 connects to a flange 93 for installation of the temporary ballast system, described below. Preferably, the firemain inlet piping 90 and common ballast/de-ballast header 92 are plumbed with 10 inch piping. The manifold system also includes 8 inch overboard piping 94 and a pneumatically operated butterfly valve 95 which fails open on loss of control air.

The common manifold header 92 includes a permanent ballast line 96, a permanent de-ballast line 97, a temporary ballast line 98, and a temporary de-ballast line 99, all preferably plumbed with 8 inch piping. The permanent ballast line 95 contains a pneumatically operated fail-shut butterfly ballast valve 101 and connects with pump caisson 10 below the overboard vent 59. The permanent de-ballast line contains a pneumatically operated fail-open butterfly de-ballast valve 122, a one-way check valve 103, and it terminates with a flange 124 above the top of the pump caissons 54 at the working flat 47. The temporary ballast line 97 contains a manually operated butterfly ballast valve 105 and terminates with a flange 106 above the top of the pump caissons 54 at the working flat 47. Finally, the temporary de-ballast line 98 contains a manual butterfly de-ballast valve 107, a one-way check valve 108, and it terminates with a flange 109 above the top of the pump caissons 54 at the working flat 47.

Submersible pumps are lowered into the caissons 54, 56 for ballasting and de-ballasting operations. A submersible ballast pump is used in an exterior caisson 56 as part of a temporary ballast system for ballasting operations during the tow and platform installation phases. After the hull 102 is locked down with tendons to the ocean floor and the top sides are installed on platform 104, ballasting is accomplished using the topsides fire water system via the firemain inlet piping 90. Primary and secondary submersible de-ballast pumps are used in the interior caissons 54 for de-ballasting.

As an alternative to lowering a submersible pump into a caisson 54 or external caisson 56, a suction line fitted with a check valve at its lower end can be lowered into the caisson. The suction line extends out of the caisson and is coupled to an inlet of a pump located at the working flats 47.

Figure 4:
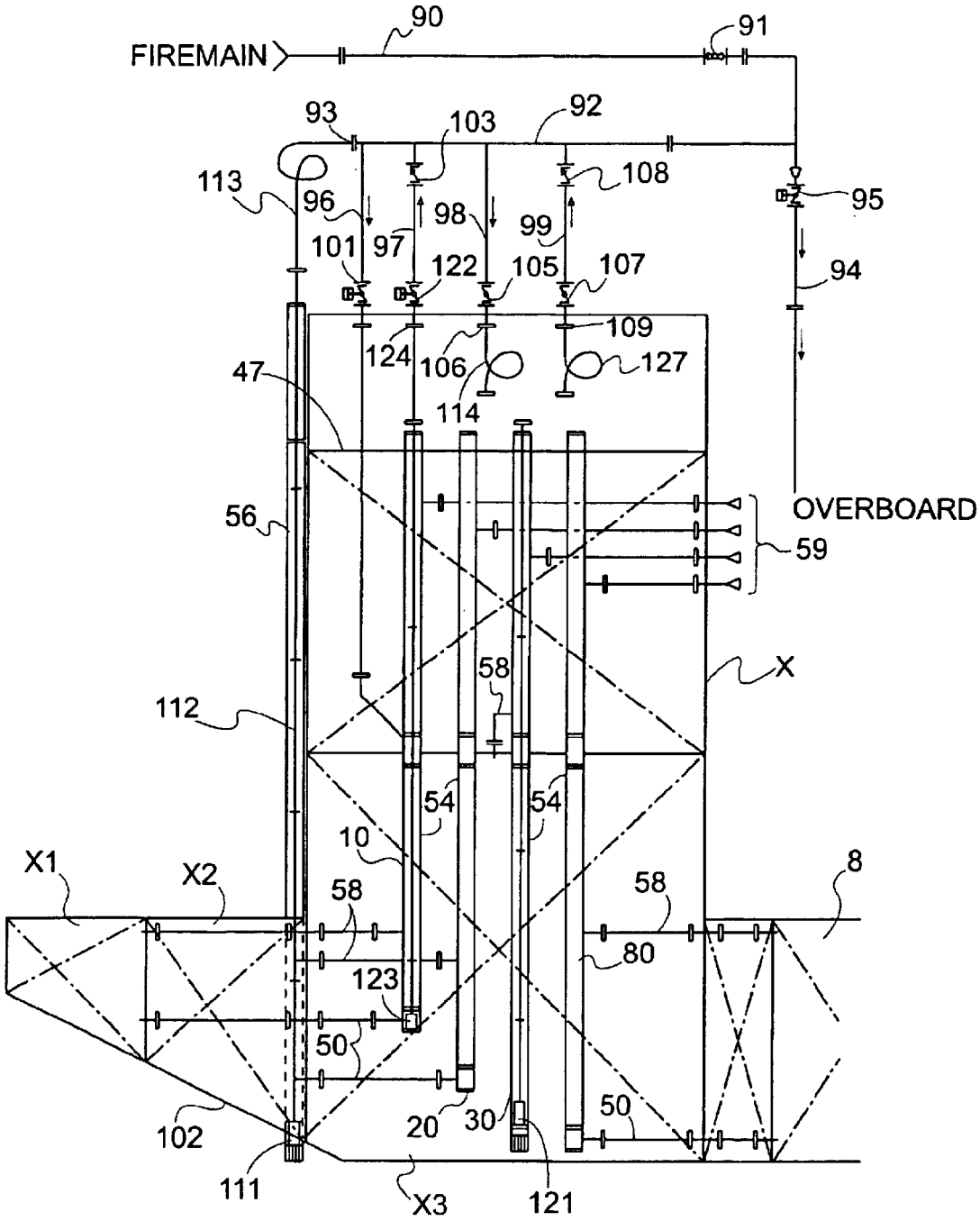
FIG. 4 is a schematic diagram showing permanent and temporary ballast systems and associated manifold piping as pre-staged for initial ballasting for tow.

FIG. 4 illustrates column X with the de-ballast and temporary ballast systems of the invention installed as pre-staged for initial ballasting. The temporary ballast components include a submersible ballast pump 111, a reinforced hose 112, a flat hose 113 and centralizers. The submersible pump is lowered by crane into an exterior pump caisson 56 and is used to bring seawater into the hull ballast tanks X1, X2, X3, 8 through the manifold located at the top of column. The pump 111 is lowered until its weight is suspended from a pad eye at the top of column X by a wire rope. The submersible ballast pump is preferably rated 1200 gpm at 240 ft total discharge head (TDH) and requires no more than 15 ft of net positive suction head (NPSH) for proper operation. EMU Pump Company manufactures a suitable submersible ballast pump.

The ballast pump 111 discharge is connected to reinforced hose 112. The pump discharge has spring roller centralizers which are used to stabilize the pump within the caisson. The centralizers are specifically designed for the internal diameters of the caissons 56. A number of centralizers are installed along the reinforced hose 112 to centralize it within the caisson 56. Above caisson 56, the reinforced hose 112 is coupled to the flat hose 113, which terminates with a flange and is secured to flange 93 at ballast/de-ballast header 92.

Inside column X, a section of flat hose 114 is attached to flange 106 and is used to connect the temporary ballast line 98 to the desired caisson 20, 30, 80. Alternatively, ballast water is directed to permanent ballast tank X1 via permanent ballast line 96.

The de-ballast system components include a set of two submersible pumps, designated primary and secondary, and associated piping. The primary de-ballast pump 121 is identical to the exterior ballast pump, rated at 1200 gpm at 240 ft TDH. The primary de-ballast pump serves as a permanent ballast pump after the TLP installation is completed. The secondary de-ballast pump 123 is used for de-ballast operations and for stripping the tanks. This pump preferably is rated at 250 gpm at 210 ft TDH and 5 ft maximum NPSH. The de-ballast pump is installed in pump caissons 54. The de-ballast system also includes handling systems for the movement of the primary and secondary de-ballast pumps. The handling system consists of an overhead hoist system and gear-operated cable reels located in column X. This equipment is provided to aid in the movement of the pumps between the internal pump caissons 54 that serve the permanent and temporary ballast tanks.

Because the primary de-ballast pump cannot be used at water levels lower than 5 ft from the suction of the pump impeller, the secondary de-ballast pump is used to drain a tank from a 5 ft to approximately a 1 ft water level. A portable pneumatic pump is used to remove any remaining water from a tank.

The primary de-ballast pump 121 is initially set into the caisson 30. The discharge of the primary de-ballast pump is connected to aluminum discharge pipe sections 125. The pump discharge has spring roller centralizers to stabilize the pump within the caisson. Aluminum discharge pipe 125 has centralizers periodically along its length. A 5-ton hoist is used to lower the primary de-ballast pump 121 into the caisson 30. The aluminum piping 125 is then ready for connection to the temporary de-ballast line 99 at flange 109 by a flat hose 127 having flanged ends.

The secondary de-ballast pump 123 is initially set into caisson 10 in a similar fashion to the primary de-ballast pump, except that a 3-ton hoist and different centralizers are used. The discharge of the secondary de-ballast pump is connected to the permanent de-ballast line 97 at flange 124.

Power is distributed from onboard switchgear to the ballast and de-ballast pumps to isolation switches located in each column interior at the working flat 47. Power from a semi-submersible construction vessel (SSCV) moored alongside TLP 100 is transferred through an umbilical cable to the onboard switchgear. Each pump is wired to an isolation switch at the working flat 47, and its electrical cable is tied to the reinforced hose as the pump is lowered into the caisson.

Before ballasting for tow to the mooring site, the installation of ballast pump 111 and de-ballast pumps 121, 123 is performed according to FIG. 4 to minimize installation time offshore. The ballast of the hull to the required tow draft is accomplished using the ballast pump 111 installed in caissons 56. Flat hose 114 is connected between flange 106 and caisson 80. Temporary power is established to the onboard switchgear. Initial valve line-up is established: valves 101, 122, 105, 107, 91 are shut, and valve 95 is open. Ballast pump 111 is energized. When steady state flow is achieved at overboard discharge line 94, temporary ballast valve 105 is slowly opened, and then overboard discharge valve 95 is shut. Tank 8 is filled. This procedure is simultaneously performed at all columns 1, 2, 3, 4, filling central tanks 5, 6, 7 until a draft of +34 ft is achieved. Once the hull is at tow draft, the ballast pump 111 is removed from the caisson 56 and secured for sea.

The hull 102 arrives at the mooring location with completely filled center 5 and wing 6, 7 tanks. The arrival draft is +34 feet. Next, the hull 102 is ballasted for lock-off to the tendons. Because the ballast pump 111 is stowed near the top of the column X, it must again be lowered into caisson 56 to begin ballast operations. The pump III is lowered with the assistance of the SSCV crane until its weight is suspended from a pad eye at the top of column X by a wire rope. As pump 111 is lowered, spring centralizers are periodically installed on hose 112, and the power and control cable is tie wrapped to hose 112. Flat hose 113 is again installed between flange 93 and reinforced hose 112 as shown in FIG. 4.

Next, power is established to the onboard switchgear from the SSCV using an umbilical cable. Ventilation is established to column X working flat 47. Instrument air for control of pneumatic valves 101, 122, 95 is established. Ballast pump 111 is wired to the isolation switch at the working flat 47. Finally, the computer control system which controls pneumatically actuated valves 101, 122, 95 is booted.

X2 is the initial tank to be filled for ballasting to lock-off depth. Flat hose 114 is connected to caisson 20. The manifold valves are lined up to direct ballast pump flow overboard, and ballast pump 111 is energized. After the manifold system has been cleared of air, the temporary ballast line valve 105 is slowly opened, and then overboard discharge valve 95 is shut. During the filling operation, the ballast operator should be checking hull trim and tank levels. Some fill adjustments may be required to maintain trim as the different ballast pumps 111 at the individual columns 1, 2, 3, 4 may pump at slightly different rates. When tank X2 is full, ballast pump 111 is de-energized and all manifold valves are shut.

When the temporary ballast tanks 12, 22, 32, 42 are all full, the flat hose 114 is relocated to caisson 30 and the fill procedure is repeated to fill tank X3. Once tanks 13, 23, 33, 43 are filled, permanent ballast tanks 11, 21, 31, 41 are partially filled using the above fill procedure, but filling by operating permanent ballast valve 101 from the computer control system until the hull 102 is at a draft sufficient for lock-off operations to commence.

The hull 102 is guided over the tendons, secured thereto, and then brought to lock-off depth (tensioning the tendons) by de-ballasting. The ballast pump 111 is disconnected from the isolation switch at the working flat 47 in column X. The primary de-ballast pump 121 is then connected to the isolation switch. The secondary de-ballast pump 123 is connected to its respective isolation switch at the working flat 47. The flat hose 127 at temporary de-ballast line 99 is connected to the aluminum pipe 125 extending from caisson 30. The temporary de-ballast valve 107 is opened, and manifold valves are lined up to direct flow overboard. The primary de-ballast pump 121 is energized, de-ballasting tank X3. The operator must pay attention to tank levels, hull trim and tendon tensions. Concurrently with de-ballasting tank X3, tank X1 may be drained by the secondary de-ballast pump 123 by energizing the pump 123 and opening valve 122, but careful monitoring of tank levels should be performed to ensure that the primary de-ballast pump 121 is not overpowering the secondary de-ballast pump. De-ballasting is continued until the tendons are tensioned by hull 102 to a storm-safe level. Once de-ballast operation is completed, de-ballast pumps 121, 123 are de-energized, and all manifold valves are shut.

Next, steel catenary risers (SCR) are installed at the TLP 100. The primary de-ballast pump is relocated from caisson 30 to caisson 20. Tanks 12, 22, 32, 43 are de-ballasted to approximately 76% capacity for the SCR installation. At this point, the hull 102 and the SSCV will de-couple, and the hull 102 will be without power.

After SCR installation, the SSCV again moors alongside hull 102 for the installation of the topside deck. Hull power is reestablished, and the computer control system is rebooted. The permanent de-ballast valve 122, the temporary de-ballast valve 107, and the overboard discharge valve 95 are opened. The primary de-ballast pump 121 and secondary de-ballast pump 123 are energized. Simultaneous de-ballast operations from tanks X1 and X2 may be accomplished, but careful monitoring of tank levels is required to ensure that the primary de-ballast pump 121 does not overpower the secondary de-ballast pump 123. X1 is de-ballasted to 50 percent tank level, and X2 is de-ballasted to 40 percent tank level. These ballast levels provide sufficient buoyancy to allow the hull 102 to accept the topsides. De-ballast pumps 121, 123 are then secured, and all manifold valves are shut. Power to the hull 102 is again removed, and the top sides are installed.

After the deck is installed, power is reestablished through the topside power distribution system, but power to the hull 102 is limited by the topsides emergency power generator rating. Available power is sufficient to operate the four secondary de-ballast pumps 123 or two 1200 gpm pumps 111, 121. X1 is de-ballasted to a 44 percent level using the secondary de-ballast pump 123 at all four columns. Next, X2 is de-ballasted to a 5 percent level using the primary de-ballast pump 121. Because of power limitations, tanks 12, 22, 32, 42 are de-ballasted in stages, two at a time. These tank levels bring the hull 102 with installed topsides to a storm-safe tendon tension.

As de-ballasting of tank X2 is proceeding, the secondary de-ballast pump 123 is removed from caisson 10 and installed in caisson 80. Ballast pump 111 is lowered into caisson 10 to become the permanent ballast pump. Eight inch fiberglass pipe sections are used for this permanent installation in place of the aluminum pipe and flat hose. Pump 111 is connected to flange 124 at the permanent ballast line 97. Ballast pump 111 now functions as the permanent ballast system.

The topside hookup is underway and permanent power, instrument air, and seawater/firewater supply are established to the hull. The temporary power is disconnected and replaced as the permanent electrical systems are installed. Concurrently, the temporary ballast tanks are stripped of all remaining water while maintaining a proper tension in the TLP tendons. Tank 8 is de-ballasted using secondary ballast pump 123 until a 1 ft level is attained within the tank. If tendon tensions approach 2500 kips ($10^3$ lbs), the de-ballast operation is suspended and permanent ballast tank X1 is ballasted using water supplied by the topsides firemain system via supply line 90. Tendon tensions are maintained below 2500 kips by cycling between deballasting X2 and ballasting X1.

The secondary de-ballast pump 123 is then removed from caisson 80 and installed in caisson 20. Temporary ballast tank X2 is de-ballasted to approximately a 1 ft tank level. The ballast in the permanent ballast tanks 11, 21, 31, 41 is adjusted to maintain tendon tensions below the 2500 kip maximum during this operation. The secondary de-ballast pump 123 is then moved to caisson 30, and the process is repeated.

The manway to the column tank X3 is opened, and the tank X3 is ventilated. Upon achieving safe atmospheric levels, personnel enter the tank with a portable pneumatic pump. The manway to the central tank 8 and the temporary ballast tank X2 are opened, and the tanks are ventilated for safe entry. Ventilation is maintained for all open tanks while personnel are inside. Portable pneumatic bilge pumps are used to strip the tanks 8, X2 of remaining ballast water. The water is discharged into the adjacent column tanks X3 through the open manways. After the water is removed the manways are permanently sealed. The secondary de-ballast pump 123 located in caisson 30 is used to bring the water level back down to 1 ft. Tank X3 is then stripped by using the portable pneumatic pump with discharge into the permanent ballast tank caisson 10. X1 is ballasted as necessary to maintain tendon tensions below the 2500 kip maximum during these operations. The secondary de-ballast pump 123 is removed from caisson 30, and tank X3 is sealed.

While the preferred embodiment of the invention has been illustrated in detail, it is apparent that modifications and adaptations of the preferred embodiment will occur to those skilled in the art. Such modifications and adaptations are in the spirit and scope of the invention as set forth in the following claims:

What is claimed is:

1. In a buoyant vessel (100) floating in a sea and comprising a hull (102) having a plurality of watertight compartments for ballasting said vessel, the improvement comprising, a plurality of caissons (54) disposed within said hull, each of said plurality of watertight compartments having a lower portion fluidly coupled to a distinct one of said plurality of caissons, wherein each of said plurality of caissons is fluidly coupled to only one of said plurality of watertight compartments, extending generally vertically from said coupled lower portion of said compartment to an upper portion of said hull and designed and arranged for receiving a submersible pump (111, 121, 123).

2. The vessel of claim 1 further comprising, a vent line (58) fluidly coupled between one of said plurality of watertight compartments and a said distinct caisson.

3. The vessel of claim 1 further comprising, a manifold system (92) fluidly coupled to a source of ballast water (90) via a first isolation valve (91), fluidly coupled to a first submersible pump (121) disposed in one of said plurality of caissons (54) via a second isolation valve (107) and a first coupling (127), fluidly coupled to said plurality of caissons (54) via a third isolation valve (105) and a second coupling (114), and fluidly coupled to an overboard discharge pipe (94) via a fourth isolation valve (95).

4. The vessel of claim 3 further comprising, an external caisson (56) disposed external to said hull (102) and in fluid communication with the sea, wherein said manifold system (92) is designed and arranged for temporary fluid coupling to a second submersible pump (111) disposed in said external caisson (56).

5. The vessel of claim 1 wherein, at least one of said plurality of caissons (54) is fluidly coupled to a void by a branch pipe (51) having an isolation valve (53).

6. The vessel of claim 1 wherein, at least two of said plurality of caissons (54) are disposed within a housing caisson (52).

7. A ballasting/de-ballasting system for a tension leg platform (100) having a hull (102) and at least one column (1, 2, 3, 4) attached thereto and extending vertically upwards, the system comprising, at least two ballast arrangements, each said ballast arrangement comprising a watertight compartment (X1, X2, X3, 8) and a caisson (10, 20, 30, 80) which is in non-isolatable fluid communication with said watertight compartment and extends generally vertically upward from said watertight compartment into one of said at least one column, and a submersible pump (121, 123) designed and arranged for use within said caisson.

8. The system of claim 7 further comprising, a manifold system (92) designed and arranged for isolatable fluid coupling to a source of ballast water (90), isolatable temporary fluid coupling to said submersible pump, isolatable temporary fluid coupling to said caisson, and isolatable fluid coupling to an overboard discharge pipe (94).

9. A method for ballasting a vessel comprising the steps of, coupling a source of ballast water with a removable conduit to a first caisson which is in non-isolatable fluid communication with a first watertight compartment, filling said first watertight compartment with water from said source of water, decoupling said source of ballast water from said first caisson, coupling said source of ballast water with said removable conduit to a second caisson which is in non-isolatable fluid communication with a second watertight compartment, and filling said second watertight compartment with water from said source of water.

10. The method of claim 9 further comprising the steps of, lowering a submersible pump into a third caisson in fluid communication with the sea, wherein discharge of water from said submersible pump provides said source of ballast water.

11. The method of claim 9 wherein, said source of ballast water is provided from a firemain.

12. A method for de-ballasting a vessel comprising the steps of, lowering a first submersible pump into a first caisson which is in non-isolatable fluid communication with a first watertight compartment, coupling a discharge of said first submersible pump with a first removable conduit to an overboard discharge, pumping water with said submersible pump from said first watertight compartment overboard, lowering a second submersible pump into a second caisson which is in non-isolatable fluid communication with a second watertight compartment, coupling discharge of said second submersible pump with a second removable conduit to said overboard discharge, and pumping water with said second submersible pump from said second watertight compartment overboard.

13. The method of claim 12 further comprising the steps of, raising said first submersible pump from said first caisson, and lowering said first submersible pump into said second caisson, wherein said first submersible pump is said second submersible pump.

14. The method of claim 13 wherein, said first removable conduit is said second removable conduit.

15. A buoyant vessel (100) floating in a sea comprising, a hull (102), a plurality of watertight compartments for ballasting, and a plurality of caissons (54) disposed within said hull, each of said plurality of watertight compartments having a lower portion fluidly coupled (50) to one of said plurality of caissons, each of said plurality of caissons being fluidly coupled to only one of said plurality of watertight compartments and extending generally vertically from a lower portion of said hull to an upper portion of said hull, each of said plurality of caissons designed and arranged to receive a suction line with a first end disposed near said lower portion of said hull and a second end coupled to a pump disposed in said upper portion of said hull.

16. The vessel of claim 15 wherein said suction line comprises a check valve disposed near said lower portion of said hull.

* * * * *